US009108230B2

(12) United States Patent
Hancock

(10) Patent No.: US 9,108,230 B2
(45) Date of Patent: Aug. 18, 2015

(54) METHOD AND APPARATUS FOR SLUDGE REMOVAL FROM A TANK

(75) Inventor: John C. Hancock, Port Isabel, TX (US)

(73) Assignee: JR & JH HOLDINGS LLC, Houston, TX (US)

( * ) Notice: Subject to any disclaimer, the term of this patent is extended or adjusted under 35 U.S.C. 154(b) by 699 days.

(21) Appl. No.: 12/273,663

(22) Filed: Nov. 19, 2008

(65) Prior Publication Data

US 2009/0071510 A1 Mar. 19, 2009

Related U.S. Application Data

(63) Continuation-in-part of application No. 11/745,326, filed on May 7, 2007, now abandoned, and a continuation-in-part of application No. 11/745,335, filed on May 7, 2007, now abandoned, and a continuation-in-part of application No. 11/745,336, filed on May 7, 2007, now abandoned.

(60) Provisional application No. 60/798,373, filed on May 5, 2006, provisional application No. 60/897,977, filed on Jan. 29, 2007.

(51) Int. Cl.
*B08B 9/093* (2006.01)
*B08B 9/08* (2006.01)

(52) U.S. Cl.
CPC ..... *B08B 9/0933* (2013.01); *B08B 9/08* (2013.01)

(58) Field of Classification Search
CPC .... B08B 9/0813; B08B 9/0933; B08B 9/0936
USPC ..... 134/22.18, 22.19, 24, 22.1
See application file for complete search history.

(56) References Cited

U.S. PATENT DOCUMENTS

| | | | | |
|---|---|---|---|---|
| 3,900,391 | A | | 8/1975 | Merrill, Jr. et al. |
| 4,623,303 | A | | 11/1986 | Henderson |
| 4,770,711 | A | * | 9/1988 | Deal et al. ..... 134/18 |
| 5,062,963 | A | * | 11/1991 | Marcinkowski et al. ..... 210/712 |
| 5,085,242 | A | * | 2/1992 | Ripley et al. ..... 137/13 |
| 5,232,596 | A | | 8/1993 | Castaldi |
| 5,234,468 | A | | 8/1993 | Khan |
| 5,810,473 | A | | 9/1998 | Manabe et al. |
| 6,041,793 | A | * | 3/2000 | Miyasaki ..... 134/22.1 |
| 6,168,708 | B1 | | 1/2001 | Burbridge et al. |

(Continued)

OTHER PUBLICATIONS

Vaughan Chopper Pumps: E-Series Chopper Pumps, Nov. 21, 2003, http://web.archive.org/web/20031121141611/http://www.chopperpumps.com/products/products.asp.*

(Continued)

*Primary Examiner* — Jason Ko
(74) *Attorney, Agent, or Firm* — Conley Rose, P.C.

(57) ABSTRACT

The present invention is directed to a method and system of processing and removing hydrocarbon sludge from a tank wherein the hydrocarbon sludges are the product of gravity settling in the bottom of the tank to form a sludge consisting of inorganic and organic materials not readily flowable or pumpable for removal in the found state and where a process is used to selectively separate, grind, disperse and suspend these materials with a mechanical classifier system, and where flow agents may be metered to effect a slurry stream directed thru a nozzle system towards the sludge in the tank and by reducing the surface tension and mechanical conditioning of the sludge, create a pumpable slurry that may be removed from the tank with minimal time, cost and environmental impact.

16 Claims, 3 Drawing Sheets

(56) References Cited

U.S. PATENT DOCUMENTS

| | | | | |
|---|---|---|---|---|
| 6,412,716 | B1 | 7/2002 | Robinson et al. | |
| 6,491,501 | B1 | 12/2002 | Wild et al. | |
| 7,713,359 | B2 * | 5/2010 | Jinback | 134/167 R |
| 2005/0033069 | A1 | 2/2005 | Holl et al. | |

OTHER PUBLICATIONS

Vaughan Chopper Pumps:Chemical Processing Applications, Aug. 18, 2003, http://web.archive.org/web/20030818180313/http://www.chopperpumps.com/apps/chemical.asp.*

* cited by examiner

100 HYDROCARBON STORAGE TANK SLUDGE REMOVAL SYSTEM

300 HYDROCARBON STORAGE TANK SLUDGE REMOVAL AND CLEANING SYSTEM

METHOD AND APPARATUS FOR SLUDGE REMOVAL FROM A TANK

CROSS REFERENCE TO RELATED APPLICATIONS

This application is a Continuation-In-Part of U.S. Ser. No. 11/745,326, entitled "Hydrocarbon Tank Cleaning Methods": U.S. Ser. No. 11/745,335, entitled "Hydrocarbon Tank Cleaning Systems"; and U.S. Ser. No. 11/745,336, entitled "Methods and Systems for Operating Large Hydrocarbon Storage Facilities" all filed on May 7, 2007 by John C. Hancock and each of which claims priority from U.S. Provisional Patent Applications 60/798,373 filed on May 5, 2006, entitled "Method of Processing and Removing Hydrocarbon Residues from a Tank", of John C. Hancock, and 60/897,977 filed on Jan. 29, 2007, entitled "Hydrocarbon Tank Cleaning Methods and Systems", also of John C. Hancock, which are all hereby incorporated herein by reference in their entirety.

FIELD OF THE INVENTION

The present invention is directed to a method and apparatus for removing sludge from a tank. More specifically, the method and apparatus are for cleaning hydrocarbon tanks, such as the tanks used in the petroleum and petrochemical industry to store hydrocarbon feed stock and hydrocarbon based oils used in all sectors of the industry.

BACKGROUND OF THE INVENTION

Sludge as a term is used herein is defined in common dictionaries. However, as a background to the present invention, an understanding of how sludge is formed is essential to the process of hydrocarbon tank sludge removal and tank cleaning.

Sludge Formation

Hydrocarbon based oils used in all sectors of the petroleum and petrochemical industry are often stored in tanks. Such storage occurs in crude oil and gas production, refineries, petrochemical plants, bulk plants, and oil storage terminals. Typical petroleum storage tanks will have a diameter from 100 to 400 feet and heights of 20 to 50 feet or more.

Over time, "sludge" forms in the bottom of these tanks. Sludge is a mixture of deposits, with a composition which varies from tank to tank. The composition of the sludge will depend upon the composition of the oil or oils that have been stored in a particular tank and/or the refining or petrochemical process associated with the tank.

A variety of materials contribute to sludge. In general, sludge can be formed from (for example) various combinations or proportions of naturally occurring sediments, higher molecular weight hydrocarbons, entrained water, as well as rust scales from piping and tank walls, inorganic debris (some from surface coatings, other from internal equipment and sampling operations), and process solids. Sludge is formed when these components are separated by gravity from the volume of liquid hydrocarbons in the storage tank. This multitude of combinations form a wide variety of sludge types, consisting of inorganic and organic materials that include, but are not limited to, organic resins, asphaltenes, paraffin compounds, heavy hydrocarbons, light hydrocarbons, gels, emulsions, rust particles, rust scales, mineral sediments, refining or petrochemical process solids, catalyst fines, pyrophoric iron sulfide deposits, glass bottles, soft lines, coating particles, coating scales, rags, gloves, cloth straps, plastics, styrene strings, bolts, iron pipe fittings, iron pipe connections, rocks, gravel, hard lines, tools, and metal straps.

Over time, the heavier elements in the stored oil will continue to migrate to the bottom of the tank and enter the sludge. As these heavier components concentrate, the sludge becomes more viscous, loses its flow characteristics, and (depending upon its composition) may even solidify. Since a large storage tank can hold a million barrels or more, and the volume which passes through a tank in the years between cleanings can be a large multiple of the tank volume, the storage tank can accumulate sludge from an enormous volume of oil.

Sludge Removal

Sludge removal or tank cleaning is required when sludge buildup interferes with or reduces the efficiency of the storage tank operation. Sludge removal or tank cleaning may also be required prior to the performance of a tank maintenance procedure, repair, modification or inspection.

All conventional techniques used to remove tank bottoms sludge from hydrocarbon storage tanks, while richly varied, can be classified under just two general methods—"Sludge Fluidization/Removal Method" and "Sludge Excavation/Removal Method". The two Methods are similar in their need to overcome the wide array of physical and chemical characteristics associated with tank bottoms sludge that make it difficult to remove, such as high surface tension, agglomerated or solidified organic fractions, high organic and inorganic solids, and poor or nonexistent flow characteristics.

Conversely, the two Methods are distinctively different in the means by which removal of sludge from the tank is accomplished.

Sludge Fluidization

The primary method used for the removal of sludge is the Sludge Fluidization/Removal Method. In general, this method relies on the use of a liquid to fluidize the sludge for removal. The most common conventional iteration of this method is known as the "Cutter Stock" technique. The Cutter Stock technique is based on the use of a large quantity of low viscosity hydrocarbon liquid, heated or at ambient temperature, to mix into the sludge, reduce sludge viscosity, modify surface tension and thereby disperse the sludge throughout the carrier fluid to effect removal. In general, this method relies on large quantities of heated or ambient temperature diluents or cutter stock (various types of light oils such as diesel oil, light cycle oil, or light crude oil) being added into the tank and to the sludge at a ratio of cutter stock to sludge ranging from 1:1 up to 20:1 depending on tank bottom conditions and the specific iteration of the cutter stock method used. The heated or ambient temperature cutter stock is used as a carrier fluid to partially solubilize the organic fraction of the sludge while reducing the viscosity of the sludge through temperature and volumetric fluid dilution. The inefficiencies of cutter stock as a carrier fluid for sludge are partially offset by the high volume ratio of cutter stock to sludge. The mechanically dispersed sludge in the high volume of cutter stock is then subsequently removed via conventional pumping methods.

Sludge removal typically involves the delivery of cutter stock to the sludge by use of a centrifugal pump and through a fixed lance or nozzle, a manually articulated lance or nozzle, or a robotic device inside the tank shell in order to disperse the sludge throughout the cutter stock through circulation of the cutter stock and dispersed sludge followed by stripping (pump off) by centrifugal or sludge pumps until suction is lost. The ratio of cutter stock to sludge ranges from 1:1 to 20:1 (cutter stock at 1.0 to 20.0 times the volume of the sludge).

After these circulation operations have gone as far as they can, a substantial amount of organic solids (resins, asphaltenes) and inorganic solids (rust scale, surface coatings, mineral sediments) and debris will typically remain in the tank. These types of solids cannot be easily removed by the cutter stock method alone. The sludge solids remaining after the completion of this step is considered residual sludge.

Residual sludge is similarly dispersed and removed by further manual or robotic injection of heated or ambient temperature cutter stock and/or diesel or light cycle oil inside the tank. Residual sludge is manually pushed to sludge pumps positioned inside the tank and/or at the sump. Residual sludge that contains rust scale or other large debris must be manually removed by shovels or manually/mechanically removed by Air Vacuum trucks into Vacuum boxes for removal and disposal by the facility.

Floor and wall cleaning is generally accomplished by use of diesel or other light cycle oil with manual scrubbing to remove sticky sludge attached to these surfaces. Scrapers may be required. Filters will be required for rust scale and other debris.

Deoiling of the interior surfaces of the tank can be done by use of a soap injection pump and manual scrubbing followed by a wash with a high pressure fire hose. Wash water can be pumped by sludge pumps to the facility's container or line for disposal or treatment. Filters or other separation devices may be required for rust scale and other debris. The floor may then be detailed by squeegee and rags as required to remove visible oil and oily stains from tank surfaces.

The problems associated with the Sludge Fluidization/Removal Method in general and the Cutter Stock technique in particular, include:

- Inefficient and time consuming (up to 3 Months for 300 foot diameter Tank)
- Adds substantial volume, treatment time, cost and logistical transfer problems.
- Heat Transfer is inefficient. Heat loss results in re-solidification of sludge and creates pumping, circulation and solids separation difficulties
- Addition of cutter stock impacts physical and chemical characteristics of recovered crude oil, fuel oil, slurry oil, etc
- Process safety concerns due to increased flammability and organic emissions.
- Results in high volume of cutter stock that requires further processing or re-refining to remove dispersed sludge.

Sludge Excavation

The secondary method conventionally used for the removal of sludge is the Sludge Excavation/Removal Method. In general, this method relies on the use of manual or mechanical methods to physically collect, excavate, and remove the sludge from the tank in its existing condition. This method is time consuming, labor intensive and expensive. The personnel working within the tank are exposed to potential health risks as well as possible injury. Despite these drawbacks, manual removal is the only conventional removal mechanism for some types of tank bottom sludge conditions. Even when the previously discussed conventional methods are employed, the sludge is often not rendered sufficiently fluid by conventional methodology to be pumped out of the tank and at least some portion must be manually removed.

The problems associated with the Sludge Excavation/Removal Method include:

- Inefficient, time consuming (up to 6 Months for 300 foot diameter Tank) and expensive;
- Increases process safety concerns due to the requirement for working for extended periods of time in a confined space;
- Results in high volume of waste requiring disposal.

All of the previously discussed conventional sludge removal methods share a common shortcoming: a substantial decrease in storage tank utilization rates due to the inability of conventional methods to predictably complete tank cleaning operations and return the capital asset (storage tank) to service in a repeatable, efficient and cost effective manner.

SUMMARY OF THE INVENTION

The present invention is directed to a method and apparatus of processing and removing hydrocarbon sludge from a tank wherein the hydrocarbon sludge are the product of gravity settling in the bottom of the tank to form sludge of inorganic and organic materials not readily flowable or pumpable for removal in the found state and where a process is used to selectively separate, grind, disperse and suspend these organic and inorganic materials with a mechanical classifier system, and where flow agents may be metered to effect a slurry stream directed thru a nozzle system towards the sludge in the tank and by reducing the surface tension and mechanical conditioning of the sludge, create a pumpable slurry that may be removed from the tank with minimal time, cost and environmental impact.

BRIEF DESCRIPTION OF THE DRAWING

The disclosed innovations will be described with reference to the accompanying drawings, which show illustrative, non-limiting embodiments of the invention and which are incorporated in the specification hereof by reference, wherein.

DESCRIPTION OF THE PREFERRED MODE OF THE PRESENT INVENTION

A unique feature of the present invention is that the hydrocarbon storage tank sludge removal and cleaning method and apparatus can be utilized for the efficient removal and transport of heavy, high solids, sticky or thixotropic hydrocarbon storage tank sludge from large or small diameter storage tanks or containers in any hydrocarbon service over the complete range of tank and tank sludge conditions. The method of the present invention is illustrated by a tank found in a conventional tank farm of a major refinery. Such tanks are usually steel structures that are up to 400 feet in diameter: however, the benefits of the present invention are not dependent upon the size or configuration of the vessel containing the sludge. They are also measured by the number of gallons or barrels of liquid that the tank can hold. Certain tanks in a tank farm are used to hold refinery materials such as black oil products (crude oil, fuel oil, clarified slurry oil, asphalt, and slop oil) while other tanks are used for intermediate product storage or final product storage, such as refined white oil products (gasoline, fuel oil, diesel and the like). The method and apparatus of the present invention are especially suitable and highly efficient in cleaning tanks that hold the heavy, black oil products, such as heavy crude oil, clarified slurry oil or high paraffin oils, those tanks that the prior art have found most challenging to clean.

Figure 1:
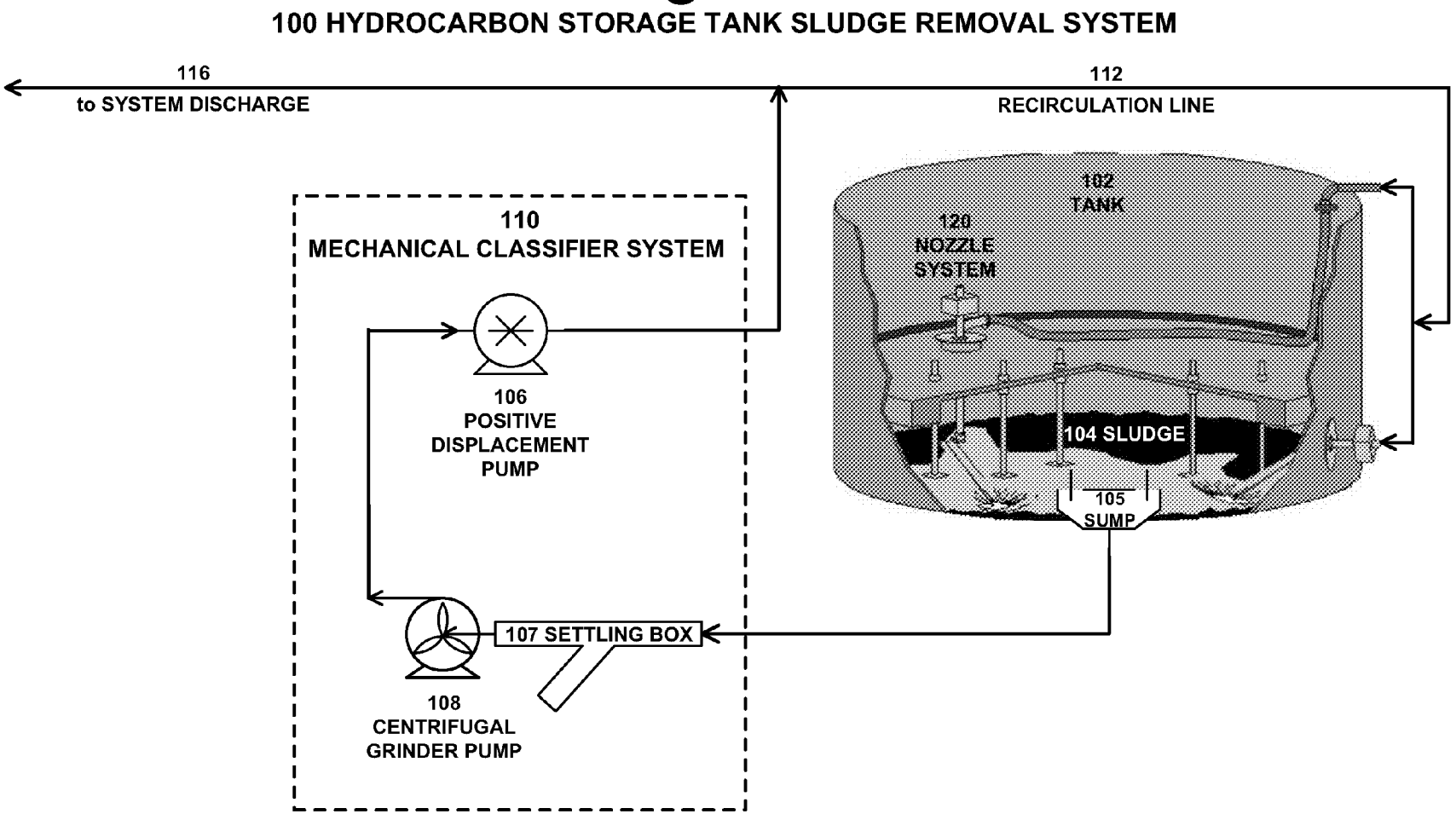
FIG. 1 is one embodiment of the systems of the present innovations.

FIG. 1 shows one embodiment of a system of the present innovations. In this example, hydrocarbon storage tank sludge removal system 100 comprises a tank 102 with sludge 104 on its interior surfaces (especially its bottom, as shown here). Fluid can be discharged from tank low point sump 105. Mechanical classifier system 110 gravity separates and removes heavy inorganic and/or metallic objects (nuts, bolts, fittings, rocks, etc.), then grinds, shears, conditions and pumps the fluids and sludge solids from sump 105 to produce a flowable slurry.

The mechanical classifier system 110 can be various types of in-line solids settling, grinding, mixing or shearing apparatus in combination with positive displacement pumping devices, as discussed below. In the presently preferred embodiment, the mechanical classifier system 110 includes solids settling box 107, grinder pump 108, and positive displacement pump 106.

Operation of the positive displacement pump 106 creates the necessary flow of the sludge through the classifier system and the piping connecting the classifier system to the tank sump or low point in the tank. The classifier system 110 and associated piping include the positive displacement pump 106; the pipeline connection from the positive displacement pump to the grinder pump; the grinder pump 108; the pipeline connection from the centrifugal grinder pump to the solids settling box; the solids settling box 107; and the pipeline connection from the solids settling box to the tank sump 105 or low point in the tank. The positive displacement pump 106 within the classifier system and its attendant piping provides sufficient force to initiate the efficient transport of fluids, sludge, sludge solids, and slurry from the tank sump 105 through the suction piping and through the classifier system 110.

Once flow is initiated within the mechanical classifier system, the grinder pump 108 feeds the input of positive displacement pump 106, so that 108 and 106 are in a supercharging relationship which improves the suction lift over that which positive displacement pump 106 could achieve alone.

The positive displacement pump 106 raises the pressure of the fluid or slurry within recirculation line 112 sufficiently to provide a strong flow stream (jet) from nozzle system 120. This stream jets onto the sludge 104, to help it move toward tank sump 105. The rated peak pressure within recirculation line 112, in this example, is 150 pounds per square inch (psi). The nozzle typically has an opening in the range of 1-inch or slightly less. Optionally of course, the system can be operated with larger or smaller nozzle sizes, or more nozzles.

After an appropriate period of recirculation to mobilize substantially all of the sludge 104 in tank 102, the discharge of mechanical classifier system 110 and/or the discharge of pump 106 can be directed through system discharge line 116 to remove the extracted slurry for further handling, processing, and/or disposition.

In the presently preferred embodiment, pump 106 is implemented by a positive displacement pump. In this sample embodiment, this is a NETZSCH Model No. NM076SY01L07V progressive cavity pump optimized for slurry pumping.

In the presently preferred embodiment, pump 108 is implemented by a grinder pump. In this sample embodiment, this is a VAUGHAN Model No. HE3G6CS-065 centrifugal grinder pump optimized for heavy slurry operations.

In the presently preferred embodiment, nozzle system 120 is implemented by an articulated nozzle system. In this sample embodiment, this is a SCANJET Model No. SC50A articulating nozzle optimized for automated pattern coverage.

Figure 2:
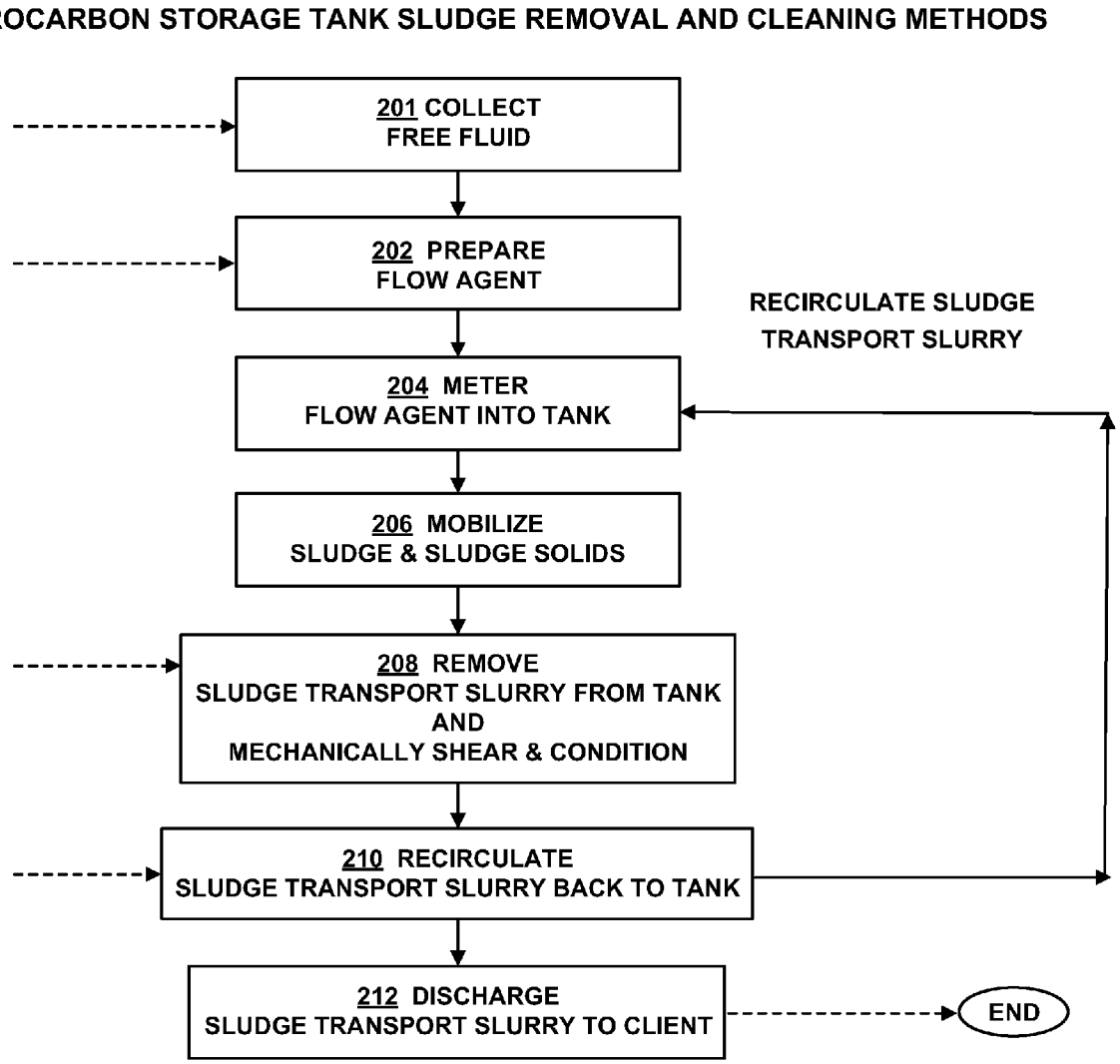
FIG. 2 shows a preferred embodiment of the methods of the present innovations.

FIG. 2 shows sequencing in a preferred embodiment of the methods of the present innovations. Hydrocarbon storage tank sludge removal and cleaning methods 200 can begin with step 201 wherein "free fluid" is collected. Free fluid is collected to supply the quantity of liquid that will be used initially to make a "flow agent" for use in mobilizing the sludge as described for FIG. 1.

In many instances, free fluid can be collected from the sludge within the tank to be cleaned. In other situations, free fluid can be secured from sources outside the tank to be cleaned. The free fluid can be any hydrocarbon of varying viscosity or density that is pumpable and flowable at ambient operating temperature conditions. However, it is preferable that the free fluid collected or secured for preparation of the flow agent have the same general characteristics of the hydrocarbon stored in the tank immediately prior to the commencement of the sludge removal and cleaning operations. The free fluid can also be water or other aqueous solutions, e.g. for cleaning a slop or waste oil tank. The required amount of collected free fluid can be variable.

The next step 202 in the preferred sludge removal and cleaning process is to prepare the flow agent. In one embodiment, the fluid from step 201 is physically conditioned through the mechanical classifier system to create the flow agent. In some versions of this embodiment no additional materials (e.g. chemicals, other hydrocarbon fluids, etc.) are added to the collected free fluid in order to prepare the flow agent. In another embodiment, such materials, collectively identified as "flow agent additives", are added to the collected free fluid via metering pump. Either one or a plurality of flow agent additives can be dosed into the collected free fluid to create the flow agent. The materials can be dosed into the collected free fluid at the appropriate efficacious dosage level to achieve the specific effect of the flow agent additive. For example, the flow agent additive can increase or decrease the viscosity and/or yield value (e.g. solids-suspending capability) of the flow agent during recirculation. Alternatively or additionally, the flow agent additive can assist in loosening the sludge from the surfaces of the tank. (This can be done by using, for example, a surface active agent or a friction modifier). Alternatively, the flow agent additive can solubilize or partially solubilize particular components within the sludge such as waxes, resins, and paraffin compounds.

The next step 204 in the process, in this embodiment, can be to meter or pump flow agent into the storage tank to be cleaned. The flow agent is not a carrier fluid but a surface tension reduction fluid that allows the sludge and solids to move, not fluidize—(fluidization of sludge is not required for sludge and solids to move).

The metering of flow agent can be conducted using a pumping system and a conduit for the fluid delivery into the tank. In the preferred embodiment, the pressure of the flow agent is increased using a positive displacement pumping system with pressure discharge into the tank through specially-designed tank cleaning nozzles or nozzle systems.

The next step 206 in the process can be to mobilize the sludge within the tank. A preferred embodiment of the present innovations is to use the pressurized flow agent as a high velocity jet or spray directed at the sludge to disrupt it, break it apart, and/or cause it to flow, either as a mass or in discrete particles or chunks, or various combinations thereof. The impact of the jet stream on the sludge may also cause the mass of sludge itself to move towards the low point in the tank more than it would have otherwise. In addition to these modes of transport, the flow agent can also carry particulates and suspended sludge. Specialized nozzle systems, temporarily or permanently installed on or within the tank, can be used to achieve the sludge mobilization. Various types of configurations of such nozzles can be utilized, including rotating, articulated, and/or multi-directional effects. Another embodiment can be to direct the flow agent through a hose connected to a tank cleaning robot which can move about the interior of a tank. The slurry formed by the flow agent in combination with the mobilized sludge is referred to as the "sludge transport slurry".

The next step 208, in the process can be to extract the sludge transport slurry from the tank, to gravity separate and remove the heavy inorganic and/or metallic objects (nuts, bolts, fittings, rocks, etc.) to protect downstream equipment, and to mechanically shear, grind, mix, condition, and pump the sludge transport slurry. A preferred embodiment of the present innovation can be to use a mechanical classifier system to remove heavy inorganic and/or metallic objects; to mechanically shear, grind, mix, and condition; and to pump or recirculated the sludge transport slurry back into the storage tank. A heavy solids settling box, followed by a centrifugal grinder pump, followed by a positive displacement pump, are collectively referred to herein as the mechanical classifier system. Heavy object separation and removal followed by mechanical grinding, shearing, mixing and conditioning provide several important benefits.

1) Rust scale and/or surface coatings from the interior surfaces of the tank (or from other upstream equipment) can dislodge into the sludge. Such rust scale and/or surface coatings can clog the nozzles used to mobilize the sludge or damage equipment in the recirculation system. Thus, such rust scale and/or surface coatings can preferably be removed to reduce the incidence of clogging. Filters could be used but such filters would quickly plug with suspended scale or coating solids (or specific components within the sludge) and require frequent cleaning. Thus, for a first effect, the present innovations can utilize mechanical shearing, grinding and conditioning of the sludge transport slurry to reduce the particle size of the rust scale and/or surface coatings without having to remove it.

2) A second effect of mechanically shearing, grinding, mixing and conditioning the sludge transport slurry can be to reduce the particle size of inorganic sludge solids such as gravel, sand, silt or clay which can exist as hardened clumps and can clog or damage equipment if allowed to recirculate.

3) A third effect of mechanically shearing, grinding, mixing and conditioning the sludge transport slurry can be to reduce the size of the hydrocarbon solids (e.g. waxes, resins, asphaltenes, paraffins, and other settled or precipitated hydrocarbon compounds or components). Reducing the size of hydrocarbon solids can assist in avoiding the clogging of the mobilization nozzles. It also can assist in suspending and/or dispersing, through a mixing action, the hydrocarbon solids and soft or semi-soft agglomerations throughout the sludge transport slurry, thereby, increasing the slurry's viscosity and suspended/dispersed solids content.

4) A fourth effect of the mechanical shearing, grinding, mixing and conditioning of the sludge transport slurry can be to reduce the particle size of all organic and inorganic sludge solids thereby increasing the total surface area of solids particles exposed to the surrounding flow agent or fluid portion of the sludge transport slurry. This can allow the surrounding flow agent or fluid portion of the sludge transport slurry to perform its physical or chemical action more effectively by contacting more surface area, thereby optimizing the solids carrying capacity of the sludge transport slurry. Specific physical or chemical actions imparted by the flow agent and/or surrounding fluid can include partial solubility of certain organic sludge components due either to the properties of the fluid itself (e.g. oil as a solvent) and/or through the action of "flow agent additives" such as, but not limited to, solvents, fluidization agents, surface active agents, dispersants, friction modifiers and emulsifiers.

The aforementioned effects were not presented in any order of importance or preference.

The next step 210 in the preferred embodiment is to recirculate the sludge transport slurry back into the tank for further sludge mobilization and removal. By continuously recirculating the sludge transport slurry out of the tank, through the mechanical classifier system and back into the tank, the solids content (e.g. weight or volume percent) in the slurry can increase until an optimum (as determined by the operator) amount of sludge and sludge solids have been dispersed, suspended, or partially solubilized in the pumpable recirculating sludge transport slurry. During such recirculation, additional flow agent additive inputs can be made to adjust for changes in the properties of the sludge transport slurry, if required. For example, the viscosity can build to too high a level. Thus, a viscosity reducing additive can be added. Adding the input prior to mechanical shearing and conditioning can have the added effect of intense mixing of the flow agent additive into the flow agent or the sludge transport slurry as aided by the high shearing action present in the centrifugal grinding pump. This intense mixing of the flow agent, sludge, and flow agent additives can result in reduced usage of such flow agent additives.

Step 210 is conditional, as illustrated by the two discharge paths. A decision whether to recirculate or to discharge the slurry can be made based on a number of criteria. In the preferred embodiment, the mechanical classifier system operator monitors the sludge transport slurry properties through periodic sample inspections. When optimum slurry conditions are observed, operator stops recirculation of sludge transport slurry back to the storage tank, and initiates discharge of the sludge transport slurry to the facility or client. The operation is essentially continuous; however, there is a batch component that requires the operator to decide whether the sludge transport slurry is to be circulated back to the tank or the sludge transport slurry has optimal (maximum) solid content, indicating discharge to facility or client. At each decision of the operator to make this batch change by discharge of the solids transport slurry to facility or client, the steps set forth above are repeated.

The next step 212 of the present innovations is to remove the sludge transport slurry from the tank and discharge to the client. As discussed above, the sump or low point in the tank is connected to the intake of the mechanical classifier system either through a suction line or through a submersible pump. The mechanical classifier system discharges the sludge transport slurry to the facility or client.

After the last removal of sludge transport slurry from the tank, a final rinse of the tank with oil or water can be performed. The decision whether to make a final rinse will be determined by the plans for the tank; for example, if tank inspection and repair is planned, complete cleaning of the tank will be needed. In other cases, the sludge removal process may be carried out merely for reduction of sludge volume, without requiring final cleaning and tank entry.

If final rinse is desired, a prepared flow agent (or water) for final rinse is pumped into the tank through the nozzle(s). This flow agent is preferably not recirculated: instead, the slurry or wastewater is pumped to discharge. Multiple iterations can be conducted to achieve removal of substantially all the sludge residue.

Figure 3:
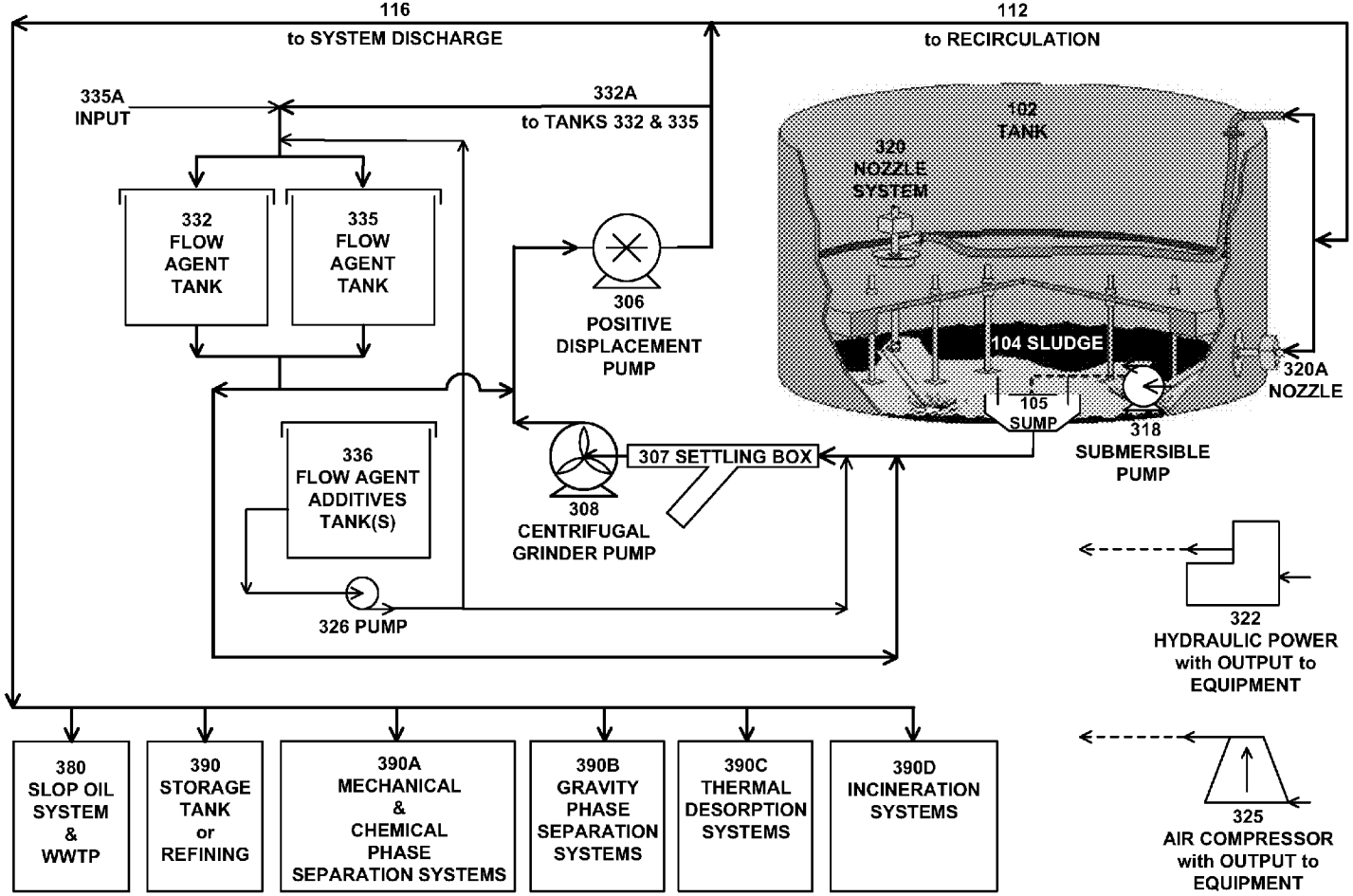
FIG. 3 shows a preferred embodiment of the systems and apparatus of the present innovations.

Referring to FIG. 3, tank 102 is a hydrocarbon storage tank containing sludge. Tank 102 is a tank found in the conventional tank farm of a major refinery. To carry out the method of the present invention, certain equipment is brought to the site of tank 102. In general, the major pieces of equipment are as follows:

Tanks 332 and 335—flow agent tanks,
Tank 336—flow agent additive (chemicals) tank(s),
Pump 326—used to meter flow agent additives,
Solids settling box 307,
Centrifugal grinder pump 308,
Positive displacement pump 306,
Nozzle systems 320 or nozzle 320A, and
Submersible pump 318

The above do not include the power or control systems, piping, manifolds, valves and other needed equipment. Even though the tanks to be cleaned are not all the same, do not have the same sludge and have specific differences, such as some have floating roofs or fixed roofs; some have manways in the sides of the tank or some have manways in the roof or some have both; some have sumps or have a low point that has changed in time due to settling of the tank; each tank 102 can utilize the same universal methods and systems of the present invention for hydrocarbon storage tank sludge removal and tank cleaning regardless of tank condition, service, size or configuration.

The following is the preferred mode of the system of the present invention

FIG. 3 shows further details of a preferred embodiment of the system of the present innovations for sludge removal and cleaning of petroleum oil storage tanks. The hydrocarbon storage tank sludge removal and cleaning system 300 can be conducted as follows. Tank 102 can normally receive, store and discharge black oil (e.g. crude oil or fuel oils) using suitable inlets and outlets of the tank (not shown). Such oil can be sent to further storage and refining 390. (Note that the facilities pumping systems which normally transport oil from one location to another within the facility are not shown. The facilities pumping system will have stripped (pumped out) the tank, to within its capabilities, before the cleaning operation starts.) A decision can be made by the client that the tank either requires completely sludge removal and final cleaning to allow for tank repair and/or inspection, or that the storage tank requires sludge removal or reduction of sludge volume to a less rigorous standard and does not require final cleaning.

To begin the sludge removal and cleaning operation, if water (not shown) is present in the tank, the water can be removed and pumped out of the tank from the low point of the tank. This can be achieved by placing submersible pump 318 at the tank low point with a hose or pipe discharge to tank sump 105 or to the suction side of centrifugal grinder pump 308. Alternatively, the suction of centrifugal grinding pump 308 can be drawn directly from the low point of a water draw or sump 105. The grinder pump can discharge the water into the suction side of a positive displacement pump 306. The positive displacement pump can discharge the water from system 300 through line 116, to the facility slop oil or wastewater treatment system 380 for recovery or disposal of the water.

The next step can be to collect or secure an adequate quantity of free fluid for preparation of the flow agent. The free fluid can be any hydrocarbon of varying viscosity or density that is pumpable, and flowable at ambient operating temperature conditions. It is preferable that the hydrocarbon free fluid collected or secured for preparation of the flow agent have the same general characteristics of the hydrocarbon stored in the tank immediately prior to the commencement of the sludge removal and cleaning operations. For example, if a crude oil tank is being cleaned, crude oil within the tank should be collected for use as the free fluid. If it is a fuel oil tank being cleaned, fuel oil in the tank should be used. Options for collection or securing of the free fluid for creation of the flow agent can include the collection of hydrocarbon fluid from the tank to be cleaned (e.g. recovered oil, not shown in FIG. 3); or securing hydrocarbon fluid from an external source. For collection of recovered oil to prepare the flow agent, the process can be to collect the free hydrocarbon fluid from the sludge in the tank to be cleaned. From a low point in the tank, the free hydrocarbon fluid can be pumped to the flow agent tanks 332 and 335 until they are full, and then any excess can be discharged to client or directed to a location outside of the cleaning operation. (Two flow agent tanks are shown in FIG. 3, but any number of flow agent tanks can be employed in the present innovations.) The transport of free fluid can be achieved by placing submersible pump 318 at the low point inside of tank 102 with the pump discharge to the tank sump 105, or to the suction side of centrifugal grinding pump 308. Alternatively, the suction of centrifugal grinding pump 308 can be drawn directly from the low point, water draw or tank sump 105 as previously described. The discharge of centrifugal pump 308 is directed to the suction side of positive displacement pump 306, through the pump, through line 332A, and to flow agent tanks 332 and 335. For collection of externally-sourced free fluid to prepare the flow agent, oil from an appropriate source can be pumped into the flow agent storage tanks 332 or 335 via input 335A. This option can be necessary if no pumpable, flowable free fluid can be recovered from the tank sludge during this initial phase.

The next step can be to prepare the flow agent. The flow agent can be prepared by conditioning the hydrocarbon free fluid collected from the tank or provided from an external source. The flow agent is the fluid used to motivate the tank bottom sludge from anywhere inside the tank to the pump suction pickup points such as sump 105, low point in tank, etc. The flow agent can include a surface tension reduction fluid or friction modifier that allows the sludge and solids to move and flow. Conditioning of the collected free fluid includes but is not limited to mechanical conditioning of the hydrocarbon fluid, the addition of flow enhancing chemical formulations or compounds (collectively referred to as flow agent additives) to the hydrocarbon fluid, or the addition of any combination of hydrocarbons and/or flow agent additives to the hydrocarbon fluid. To prepare the flow agent by mechanical conditioning, the hydrocarbon free fluid staged in flow agent tanks 332 and 335 can flow from the discharge of the flow agent tanks to the suction side of centrifugal shearing pump 308, through the centrifugal grinding pump, into the suction side of the positive displacement pump 306, through the positive displacement pump and back to the flow agent tanks 332 and 335. The flow agent can be circulated as required to adjust its flow properties via mechanical conditioning. To prepare the flow agent by adding conditioning chemical or chemicals to the hydrocarbon fluid staged in the flow agent tanks, the conditioning chemicals or combination thereof, referred to as "flow agent additives", will be staged in additional tanks such as tank(s) 336. The flow agent additives are pumped from the tank(s) 336 using a metering pump 326, to the flow agent tanks or to the suction side of the mechanical classifier system. The mechanical classifier system, previously identified as 110 in FIG. 1, can be comprised of the settling box 307, the centrifugal grinder pump 308, and the positive displacement pump 306.

The next step can be to begin the motivation and removal of the sludge 104. The motivation of tank bottom sludge can be initiated by the controlled pumping or "metering" of the prepared flow agent from flow agent tank(s) 332 and 335, through the positive displacement pump 306, under pressure through recirculation line 112, through the nozzle system 320 or nozzle 320A and into the tank bottoms sludge within tank 102. The action of the flow agent on the sludge solids can be to enhance sludge solids movement to tank collection areas for suction pickup, followed by the mechanical commingling of the flow agent and the sludge solids in the mechanical classifier system (settling box 307, centrifugal grinder pump 308 and positive displacement pump 306) and nozzle delivery system to create a "sludge transport slurry", wherein the sludge transport slurry has increased solids carrying capacity as recirculation is continued through line 112 to nozzle system 320 or nozzle 320A. Note that nozzle system 320 and nozzle 320A can be automatically articulated through a series of multi-directional nozzle coverage patterns to provide mobilizing action for the full range of interior surfaces of the tank.

To achieve sludge motivation and removal, flow agent, staged in the flow agent tanks 332 and 335 can be metered into tank 102 by means of the positive displacement pump 306. The flow agent is pumped under pressure to the automatic articulated circulation nozzles, which can be attached to the tank at a manway on the side or roof of tank 102. The flow agent (and subsequent recirculated slurry) can be jetted into the sludge in a coherent stream. Stream lengths of 90 feet can be achieved. The flow agent (and subsequent recirculated slurry) can impact the sludge causing it to move or flow to the low points in the tank wherein the slurry and sludge are then picked up by pump suction (either pump 318 and/or pump 306 and/or pump 308 suctions), commingled and conditioned through the mechanical classifier system, previously identified as 110 in FIG. 1, thereby creating a conditioned sludge transport slurry which is then pumped under pressure back to the tank through recirculation line 112, through the nozzle systems 320 or nozzle 320A where the sludge transport slurry again picks up more solids, flows to the low points in the tank and is again picked up by mechanical classifier system pump suction for additional recirculation.

The recirculation phase of the cleaning operation can be completed and discontinued when the sludge transport slurry no longer can accumulate additional sludge solids as determined through periodic operator sample inspections. The sludge transport slurry can then be pumped out of the system by the mechanical classifier system through system discharge line 116 to a client or facility designated location.

The finished sludge transport slurry can also be pumped to optional client or facility designated secondary processing equipment systems for phase separation, resource recovery and/or treatment. Secondary process equipment systems include any mechanical, chemical, or thermal process, complete with the requisite process support equipment, or combination thereof, to separate, modify, eliminate, treat, recover or dispose of any component or combination of components within the sludge transport slurry. Some examples of secondary process equipment systems include mechanical/chemical phase separation systems 390A, gravity phase separation systems 390B, and thermal desorption 390C or incineration 390D systems.

Up to this point in the sludge removal and cleaning operation, all steps can be accomplished without entering the tank and without personnel working inside the tank (other than to set the submersible pump 318 if required, which would be done with the workers using personnel protective equipment and self-contained breathing apparatus).

Upon the completion of the sludge transport slurry recirculation and discharge phase, and if final cleaning of the storage tank is required, entry can be made into the tank to initiate a sludge wash-down phase through the continued removal of any remaining residual sludge. Residual sludge wash down can involve the controlled pumping or metering of the prepared flow agent under pressure through a manually articulated wash down nozzle and into the remaining residual sludge within the tank to enhance sludge solids flow to tank collection areas for suction pickup. During the sludge wash-down phase, the flow agent, staged in the flow agent tanks 332 and 335, can be metered into the tank by means of diaphragm pumps (not shown) through a wash down nozzle which is manually articulated (not shown). The resultant slurry can then be pumped out of the tank using the mechanical classifier system to a designated location or to optional secondary processing equipment systems for phase separation and/or treatment.

The final step can be a water wash down phase, if required. This step includes the use of surfactants or other cleaning chemicals if required.

The systems of FIG. 3 can also include hydraulic power unit 322 to supply hydraulic power to drive the various pieces of equipment (such as pumps) and air compressor unit 325 to supply pneumatic power to also drive pieces of equipment (such as air-powered diaphragm pumps or control actuators)

The invention claimed is:

1. A sludge removal and tank cleaning system comprising:

an external tank conduit placed in fluid communication between an outlet of a sludge containing tank and a jet nozzle inlet of the sludge containing tank;

a grinder pump coupled to the external tank conduit to receive unfiltered sludge from the outlet, the grinder pump configured to receive the sludge at a first pressure and with sludge solids at a first size, and to pressurize the sludge to a second, increased pressure and to grind the sludge solids to a second, reduced size thereby outputting a flowable slurry in the external tank conduit; and a positive displacement pump coupled to the external tank conduit downstream of the grinder pump, the positive displacement pump configured to receive the flowable slurry at the second, increased pressure, to pressurize the flowable slurry to a supercharged pressure, and to output the supercharged flowable slurry to the jet nozzle inlet for jet streaming the flowable slurry from the jet nozzle onto the settled sludge to mechanically condition the settled sludge, whereby the flowable slurry is removable from the tank;

wherein the external tank conduit, the jet nozzle, the grinder pump, and the positive displacement pump are attachable to and removable from the sludge containing tank.

2. A system according to claim 1, wherein the conduit further comprises an inlet for introducing a flow agent to said flowable slurry.

3. A system according to claim 2, wherein the conduit further comprises an inlet for introducing additives to said flow agent and flowable slurry.

4. A system according to claim 1, wherein the conduit further comprises a solids settling box for gravity removal of large solids in said sludge.

5. A system according to claim 1 further comprising a submersible pump insertable through a manway of the sludge containing tank and configured to pump sludge to the outlet of the tank, the submersible pump being attachable to and removable from the sludge containing tank.

6. A sludge removal and tank cleaning system comprising:

a submersible pump positionable in a tank through a manway at a low point in the tank and in fluid communication with an inlet of an external tank conduit;

a grinder pump coupled to the external tank conduit and in fluid communication with the submersible pump via the conduit; and a positive displacement pump coupled to the external tank conduit and downstream of and in fluid communication between the grinder pump and one or more jet nozzles on said tank for moving unfiltered sludge toward said submersible pump;

wherein the submersible pump is operable to pressurize the sludge to a first pressure at the inlet of the external tank conduit;

wherein the grinder pump is operable to apply a first pressure differential to the unfiltered sludge and to grind sludge solids to output a flowable slurry at a second, increased pressure and with reduced-sized sludge solids;

wherein the positive displacement pump is operable to apply a second pressure differential to the flowable slurry to output the flowable slurry to the one or more jet nozzles at a third, supercharged pressure for jet streaming the flowable slurry from the one or more jet nozzles onto the settled sludge to mechanically condition the settled sludge, whereby the flowable slurry is removable from the tank;

wherein the submersible pump, the grinder pump, the positive displacement pump, and the one or more jet nozzles are attachable to and removable from the sludge containing tank.

7. A tank cleaning system according to claim 6 comprising: an injection pump in fluid communication with the conduit and configured to inject a flow agent, the injection pump being attachable to and removable from the sludge containing tank.

8. A tank cleaning system according to claim 7, wherein a flow agent comprises a fluid that has been recovered from the tank.

9. A tank cleaning system according to claim 7, wherein the injection pump is in fluid communication with a flow agent additive source.

10. A tank cleaning system according to claim 7, wherein the injection pump is in fluid communication with said conduit in at least one location chosen from the group consisting of: between said inlet and said grinder pump, between said grinder pump and said positive displacement pump, and between said positive displacement pump and said one or more jet nozzles.

11. A tank cleaning system according to claim 6, wherein the submersible pump is configured to pump sludge to the grinder pump.

12. A tank cleaning system according to claim 6, wherein the grinder pump is configured to supply the suction side of the positive displacement pump with a flowable slurry comprising mechanically reduced solids suspended in a liquid.

13. A tank cleaning system according to claim 6, wherein the positive displacement pump feeds the one or more jet nozzles a recirculated sludge slurry.

14. A tank cleaning system according to claim 13, wherein the one or more jet nozzles comprise articulating, multi-directional nozzles.

15. A tank cleaning system according to claim 14, wherein the one or more multi-directional jet nozzles are configured to produce a coherent stream of flow agent or recirculated sludge slurry.

16. A tank cleaning system according to claim 13, wherein the one or more jet nozzles are configured to flow the recirculated sludge slurry comprising a mechanically reduced solids in a liquid.

* * * * *